US009612035B1

(12) United States Patent
Winters

(10) Patent No.: US 9,612,035 B1
(45) Date of Patent: Apr. 4, 2017

(54) MIRROR DEFOGGER

(71) Applicant: Wintervention, LLC, Princeton, NJ (US)

(72) Inventor: Frank Winters, Princeton, NJ (US)

(73) Assignee: WINTERVENTION, Princeton, NJ (US)

( * ) Notice: Subject to any disclaimer, the term of this patent is extended or adjusted under 35 U.S.C. 154(b) by 0 days.

(21) Appl. No.: 14/688,021

(22) Filed: Apr. 16, 2015

(51) Int. Cl.

| | |
|---|---|
| ***H05B 1/02*** | (2006.01) |
| ***F24H 3/04*** | (2006.01) |
| ***F24H 9/06*** | (2006.01) |
| ***F24H 9/00*** | (2006.01) |
| ***H05B 3/84*** | (2006.01) |

(52) U.S. Cl.
CPC ..... *F24H 3/0405* (2013.01); *F24H 9/0057* (2013.01); *F24H 9/06* (2013.01); *H05B 3/845* (2013.01)

(58) Field of Classification Search
CPC ..... F24H 3/0405; F24H 3/06; F24H 9/0057; H05B 3/845; H05B 1/0244; H05B 1/0236
USPC ..... 219/202, 203, 219, 494, 508–510, 222
See application file for complete search history.

(56) References Cited

U.S. PATENT DOCUMENTS

| | | | | |
|---|---|---|---|---|
| 1,465,292 A | | 8/1923 | Wessig | |
| 2,121,753 A | * | 6/1938 | Cornell, Jr. | B60S 1/54 15/300.1 |
| 2,617,701 A | | 11/1952 | Fennell | |
| 3,530,275 A | | 9/1970 | Rust | |
| 4,037,079 A | | 7/1977 | Armbruster | |
| 4,150,869 A | | 4/1979 | Hansen | |
| 4,366,368 A | * | 12/1982 | Stephens, III | F24H 3/062 15/405 |
| 4,594,797 A | | 6/1986 | Houck | |
| 4,653,201 A | | 3/1987 | Seaman | |

(Continued)

FOREIGN PATENT DOCUMENTS

| | | |
|---|---|---|
| CN | 2779785 | 5/2006 |
| CN | 201015510 | 2/2008 |

(Continued)

OTHER PUBLICATIONS

Knotts, Steve, Active Bathroom Mirror Defogger, Kickstarter Website, https://www.kickstarter.com/projects/1511132316/active-bathroom-mirror-defogger, Mar. 19, 2015.

*Primary Examiner* — Mark Paschall
(74) *Attorney, Agent, or Firm* — Werschulz Patent Law, LLC

(57) ABSTRACT

An adaptable system for defogging a mirror in a steamy bathroom having a tube assembly with a plurality of openings with an impeller and a plurality of heating elements for blowing hot air through the openings onto the fogged mirror. In one example embodiment, the tube assembly has louvers directing the hot air from the openings. The system has a plurality of mounting assemblies configured for all types of mirrors operative for coupling to the tube assembly, such as a portable mounting assembly with a rechargeable battery that selectively attaches on or adjacent to a mirror. The system has an articulated arm mounting assembly in one example embodiment. The system has a mounting assembly fixture in another example embodiment. A kit comprises the tube assembly and at least one mounting assembly.

20 Claims, 8 Drawing Sheets

(56) References Cited

U.S. PATENT DOCUMENTS

| | | | | | |
|---|---|---|---|---|---|
| 4,701,594 | A | | 10/1987 | Powell | |
| 4,882,467 | A | | 11/1989 | Dimick | |
| 4,988,847 | A | | 1/1991 | Argos et al. | |
| 5,063,283 | A | | 11/1991 | Orazi | |
| 5,251,066 | A | * | 10/1993 | Appelbaum | A47G 1/02 359/509 |
| D347,275 | S | | 5/1994 | Lovell | |
| 5,467,423 | A | * | 11/1995 | Jakubowski | A47G 1/02 15/250.03 |
| D372,773 | S | | 8/1996 | Young | |
| 5,642,462 | A | * | 6/1997 | Huff | A47K 10/06 211/105.1 |
| 5,731,569 | A | * | 3/1998 | Crescenzo | H05B 3/845 219/219 |
| 5,987,216 | A | * | 11/1999 | Krug | B60H 1/3407 219/203 |
| 6,100,500 | A | * | 8/2000 | Jefferson, Jr. | H05B 3/84 219/203 |
| 7,267,462 | B2 | * | 9/2007 | Cronin | A47G 1/00 34/90 |
| 8,420,985 | B2 | | 4/2013 | Dallaire | |
| 2001/0050274 | A1 | | 12/2001 | Decker | |
| 2011/0168687 | A1 | * | 7/2011 | Door | H05B 3/845 219/202 |

FOREIGN PATENT DOCUMENTS

| | | | |
|---|---|---|---|
| CN | 201131544 | | 10/2008 |
| CN | 203059088 | U | 7/2013 |
| FR | 2566650 | A1 | 1/1986 |
| WO | 9006707 | A1 | 6/1990 |

* cited by examiner

MIRROR DEFOGGER

TECHNICAL FIELD

The present disclosure relates generally to a mirror defogger. More particularly, the present disclosure relates to a mirror defogging system.

BACKGROUND

Bathroom mirrors fog, that is, become covered with steam, when a nearby shower or bath is running. Generally the entire room becomes steamy and remains steamy for a period after the shower or bath. The mirror is usually the last surface from which the steam disappears.

Unfortunately a fogged mirror is useless for shaving, applying makeup, styling hair and all those tasks that are required by a person to look presentable when preparing for the day's or evening's events.

People are impatient and have tried many things to either prevent the problem of mirror fogging or to quickly remedy it. Ceiling fans, exhaust fans and hair dryers are often employed with limited success. The ceiling fans and exhaust fans clear the steam in general, but do little to remove the fog on the mirror. As long as the surface of the mirror is cooler than room temperature, the moisture will continue to condense on the mirror surface.

A popular trick is to apply a hair dryer to the mirror. However, the hair dryer has a single focal point of hot air. The hair dryer heats relatively small areas on the surface of the mirror and it is a slow, tedious process. Often the mirror starts to fog over again before the user is finished removing the fog.

While these units may be suitable for the particular purpose employed, or for general use, they would not be as suitable for the purposes of the present disclosure as disclosed hereafter.

In the present disclosure, where a document, act or item of knowledge is referred to or discussed, this reference or discussion is not an admission that the document, act or item of knowledge or any combination thereof was at the priority date, publicly available, known to the public, part of common general knowledge or otherwise constitutes prior art under the applicable statutory provisions; or is known to be relevant to an attempt to solve any problem with which the present disclosure is concerned.

While certain aspects of conventional technologies have been discussed to facilitate the present disclosure, no technical aspects are disclaimed and it is contemplated that the claims may encompass one or more of the conventional technical aspects discussed herein.

BRIEF SUMMARY

An aspect of an example embodiment in the present disclosure is to provide a system for defogging a mirror in a steamy bathroom. Accordingly, an aspect of an example embodiment in the present disclosure provides a tube assembly with an impeller and a plurality of heating elements for blowing hot air onto a fogged mirror.

Another aspect of an example embodiment in the present disclosure is to provide a system for defogging a mirror that is adaptable. Accordingly, the present disclosure provides a system for defogging a mirror that has a plurality of mounting assemblies for a tube assembly for blowing hot air on a fogged mirror, the mounting assemblies configured for all types of mirrors.

A further aspect of an example embodiment in the present disclosure is to provide a portable system for defogging a mirror. Accordingly, the present disclosure provides a system that has a tube assembly for blowing hot air on a fogged mirror and a portable mounting assembly with a rechargeable battery that selectively attaches on or adjacent to a mirror.

Accordingly, the present disclosure describes an adaptable system for defogging a mirror in a steamy bathroom. The system has an impeller and a plurality of heating elements in a tube assembly for blowing hot air on the fogged mirror. In one example embodiment, the tube assembly has louvers. The system has a plurality of mounting assemblies configured for all types of mirrors coupled to the tube assembly for blowing hot air on a fogged mirror, such as a portable mounting assembly with a rechargeable battery that selectively attaches on or adjacent to a mirror. The system has an articulated arm mounting assembly in one example embodiment. The system has a mounting assembly fixture in another example embodiment. A kit comprises the tube assembly and at least one mounting assembly.

The present disclosure addresses at least one of the disadvantages of the prior art. However, it is contemplated that the present disclosure may prove useful in addressing other problems and deficiencies in a number of technical areas. Therefore, the claims should not necessarily be construed as limited to addressing any of the particular problems or deficiencies discussed hereinabove. To the accomplishment of the above, this disclosure may be embodied in the form illustrated in the accompanying drawings. Attention is called to the fact, however, that the drawings are illustrative only. Variations are contemplated as being part of the disclosure.

BRIEF DESCRIPTION OF THE DRAWINGS

In the drawings, like elements are depicted by like reference numerals. The drawings are briefly described as follows.

The present disclosure now will be described more fully hereinafter with reference to the accompanying drawings, which show various example embodiments. However, the present disclosure may be embodied in many different forms and should not be construed as limited to the example embodiments set forth herein. Rather, these example embodiments are provided so that the present disclosure is thorough, complete and fully conveys the scope of the present disclosure to those skilled in the art.

DETAILED DESCRIPTION OF THE PREFERRED EMBODIMENTS

Figure 7:
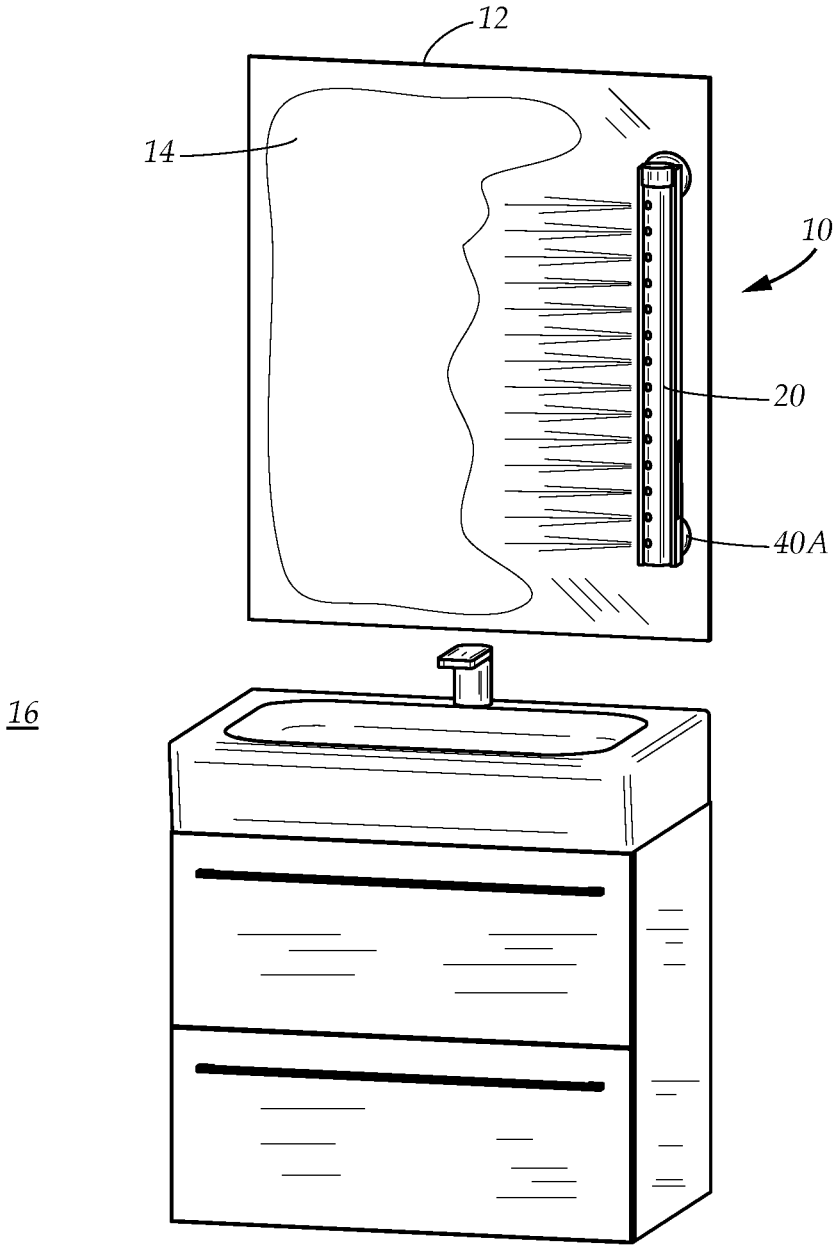
FIG. 7 is a perspective view of an example embodiment of the mirror defogger system defogging a mirror.

FIG. 7 illustrates an example embodiment of a mirror defogging system 10 configured for defogging a mirror 12 by eliminating condensate 14 from the mirror surface. In a typical bathroom as illustrated in FIG. 7, the mirror 12 hangs on a wall 16. However, it is understood that other configurations are possible, such as a free-standing mirror on a pedestal, a mirror attaching to the wall by an accordion mount or an articulated arm. As explained below, the mirror defogging system is configured to defog mirrors in various configurations and is not limited to a wall-mounted mirror 12.

The mirror defogging system 10 has a tube assembly 20 selectively coupling to a mounting assembly 40 described in detail hereinbelow. The mirror defogging system has a plurality of mounting assemblies adaptable for portability as well as various configurations of mirrors. The mounting assembly 40A in FIG. 7 is a first example embodiment of possible mounting assemblies. The mounting assembly 40A receives the tube assembly 20, positioning the tube assembly 20 on or in proximity to the mirror 12. All the mounting assemblies described herein are configured to receive the tube assembly 20.

Figure 1:
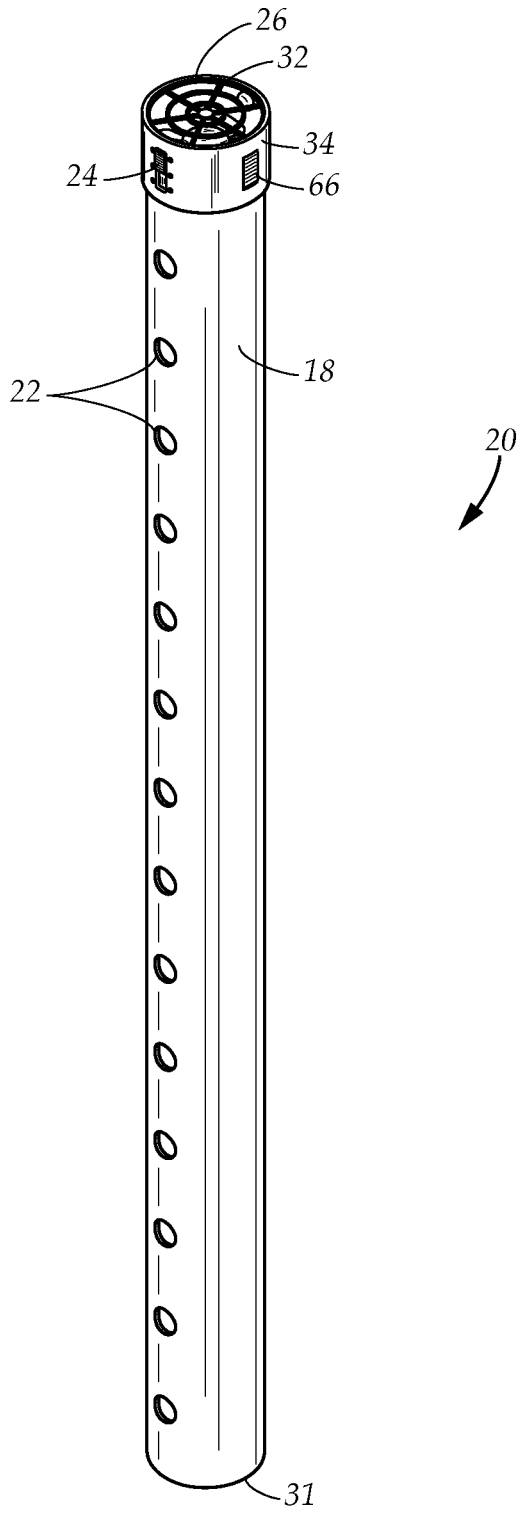
FIG. 1 is a perspective view of an example embodiment of a tube assembly of a mirror defogger.

FIG. 1 illustrates an example embodiment of the tube assembly 20 in detail. The tube assembly 20 has a tube 18 with an open end 32 and a closed end 31. The tube 18 has a plurality of longitudinally recurring openings 22. In one example embodiment, the openings 22 are in a linear arrangement. However, it is understood that other longitudinal patterns are possible within the inventive concept.

The open end 32 of the tube 18 has a collar 34 encircling the open end. The open end 32 is covered by an open grill 26 to prevent accidents.

On the collar 34 are at least one electrical contact 66 and at least one switch 24. The at least one switch 24 has a plurality of settings such as "ON," "OFF," "AUTO," "HIGH," and "LOW," as non-limiting examples.

Figure 2:
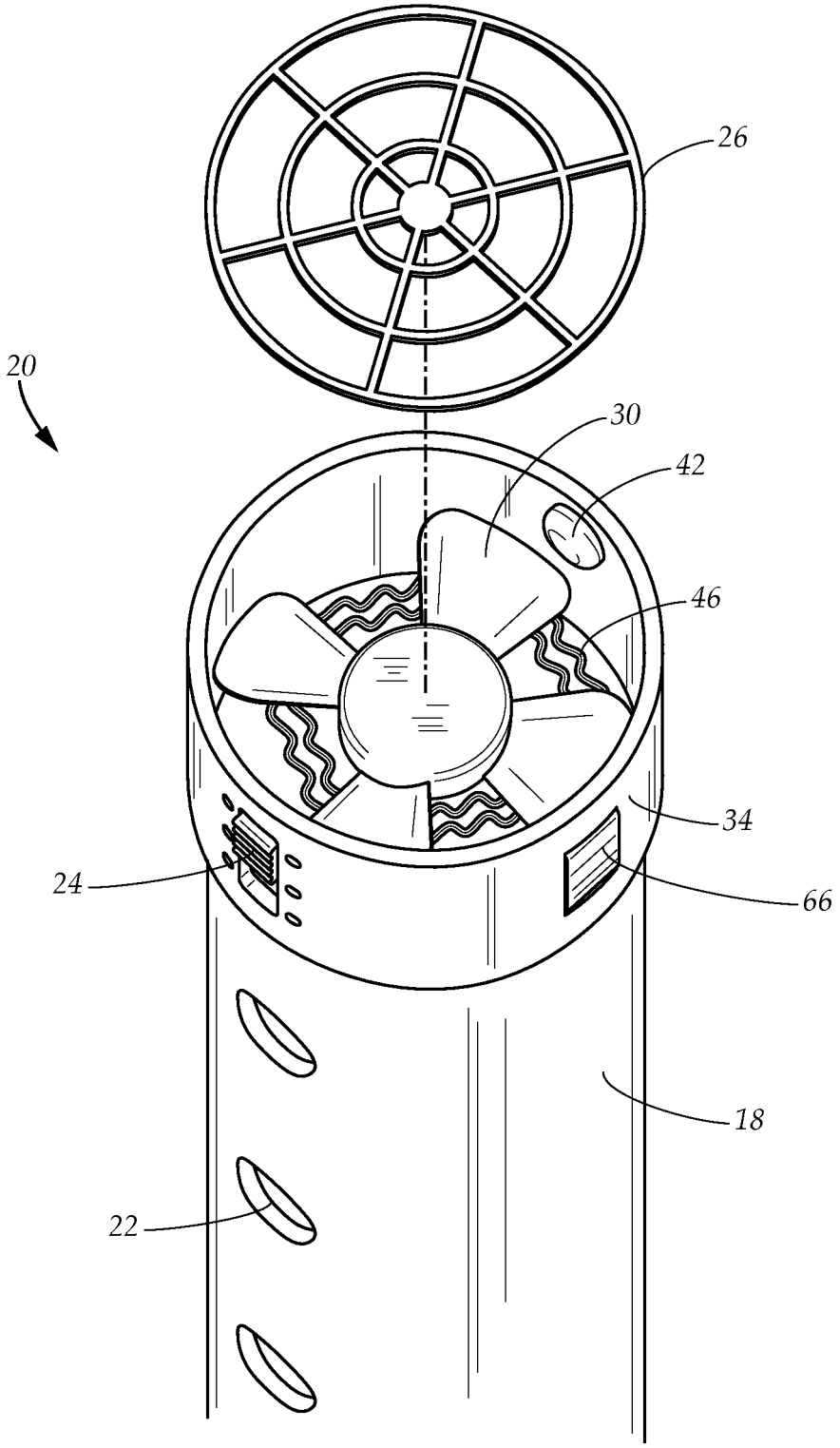
FIG. 2 is an exploded perspective view of a top of the example embodiment of the tube assembly, showing interior features.

FIG. 2 shows the open end 32 of the tube 18 in greater detail. The tube 18 has an impeller 30 and a plurality of heating elements 46 towards the open end 32 of the tube 18. The impeller 30 is powered by an electrical motor that is not shown. In one example embodiment, the impeller 30 has a variable speed motor. The at least one contact 66 electrical couples the tube assembly 20 to the mounting assembly to power the impeller 30 and heating elements 46. The impeller 30 and the heating elements 46 blowing heated air through the openings 22 for defogging the mirror. In a further example embodiment, the impeller 30 is an axial impeller having an axis of rotation orthogonal to the tube 18.

The tube assembly 20 has a sensor 42, shown in the illustration inside the collar 34, but the sensor 42 can be anywhere in or on the tube assembly 20 or anywhere in or on the mirror defogging system, and the location on the collar 34 is not a limitation. The sensor 42 can be a moisture sensor that detects the presence of condensate, a humidity sensor or a heat sensor. The sensor 42 initiates the impeller 30 and heating elements 46 when pre-set conditions are sensed and terminates the impeller 30 and heating elements 46 when the pre-set conditions no longer exist and are no longer sensed. In one example embodiment, the sensor functions when the at least one switch 24 is in "AUTO" setting.

In a further example embodiment, the collar 34 and the grill 26 form a resonator to reduce noise of the impeller 30.

In yet another example embodiment, the grill 26 is configured to maintain a scent sachet that produces aromatherapy when the heating elements 46 are on.

Figure 3A:
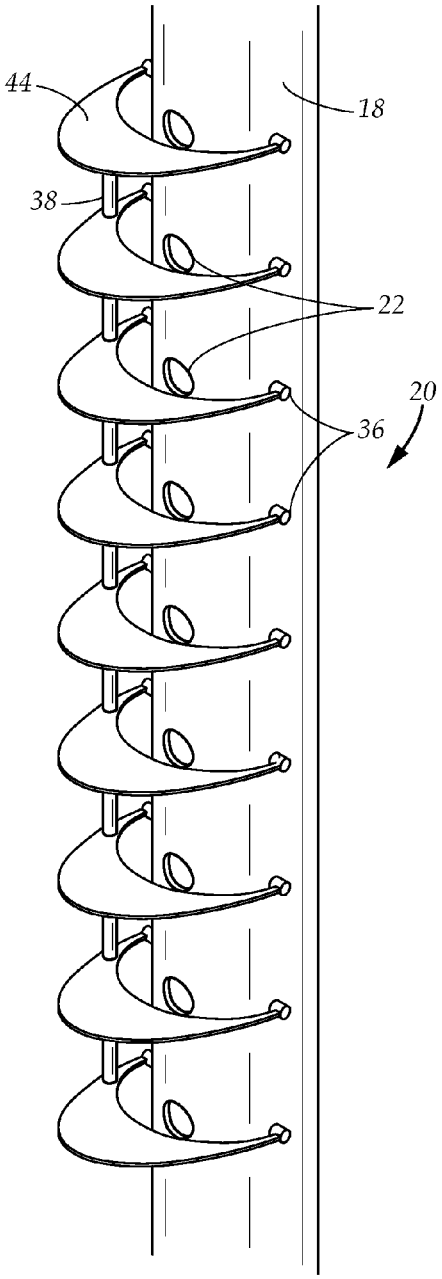
FIG. 3A is a perspective view of another example embodiment of a tube assembly.

FIG. 3A show a further example embodiment of the tube assembly 20 comprising a plurality of adjustable louvers 44 adjacent to the openings 22 on the tube 18. The louvers 44 are operative for directing heated air onto the fogged mirror. The louvers 44 hingedly connect to the tube 18, having a pair of pivots 36 attaching each louver 44 to the tube 18, one pivot on each end of the louver, allowing the louvers to adjust the airflow. In one example embodiment, the louvers 44 are coupled by a bar 38 to move simultaneously. It should be noted that in the other illustrations, the louvers are not shown for the sake of clarity. It should be understood that the louvers 44 optionally can be coupled to the tube assembly 20 in each of the example embodiments described herein.

Figure 3B:
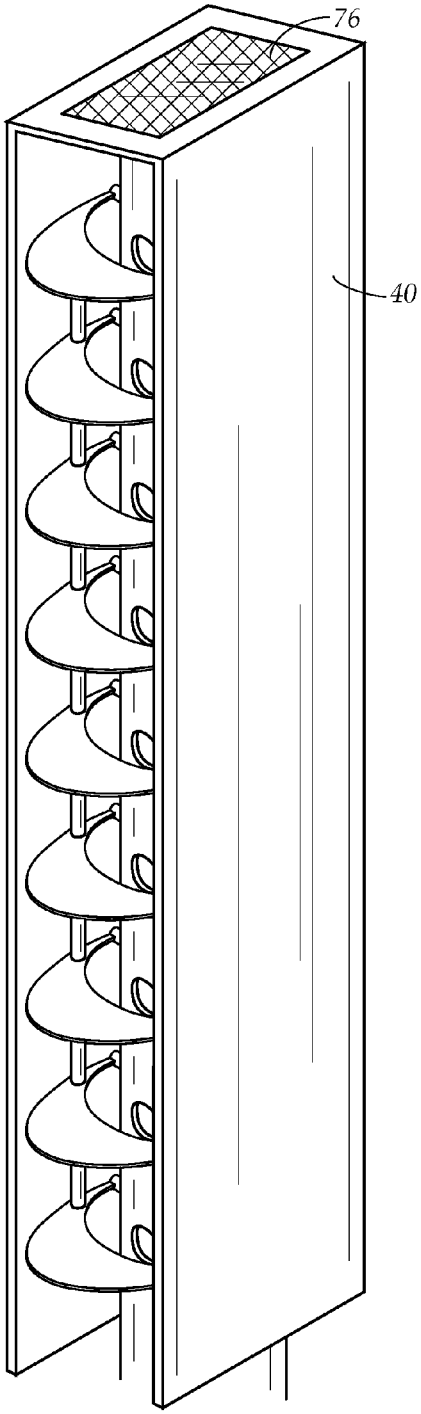
FIG. 3B, similar to FIG. 3A, is a perspective view of another example embodiment of the tube in a mounting box assembly.

FIG. 3B illustrates an example embodiment of a mounting assembly 40 as an installed fixture. The mounting assembly 40 is configured for receiving the tube assembly 20. The tube assembly 20 selectively couples to the mounting assembly 40. The mounting assembly 40 is operative for positioning the tube assembly 20 on or in proximity to the fogged mirror. The tube assembly 20 is electrically coupled to the mounting assembly 40, operative for powering the tube assembly impeller and tube assembly heating elements described hereinabove.

In one example embodiment, the mounting assembly 40 has a wireless speaker 76 for transmitting music or audio programs to enhance the lavatory experience.

Figure 4:
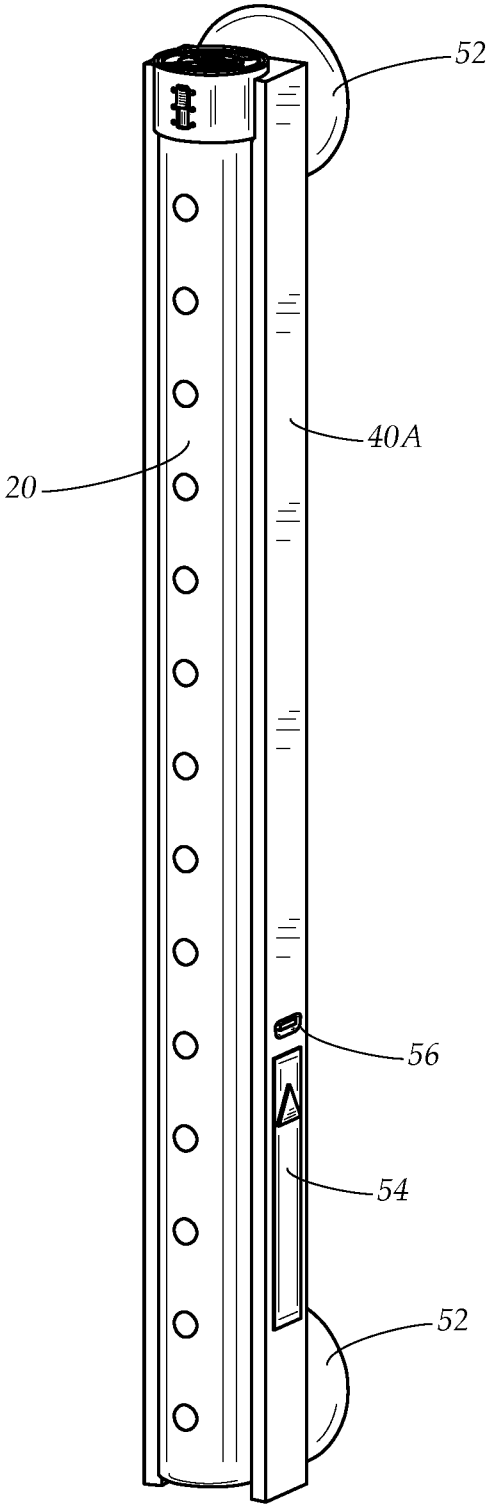
FIG. 4 is a perspective view of a further example embodiment of a portable mounting assembly coupled to the tube assembly.

In FIG. 4, another example embodiment of the mounting assembly 40A is illustrated. The mounting assembly 40A is portable and can be selectively mounted on or adjacent to a mirror as needed. The tube assembly 20 couples to the mounting assembly 40A by snapping in and out of the mounting assembly 40A. The tube assembly 20 is electrically coupled to the mounting assembly 40A, operative for powering the tube assembly impeller and tube assembly heating elements described hereinabove. The mounting assembly 40A has a battery compartment 54 housing a rechargeable battery and a charging port 56. In the illustration, the mounting assembly 40A mounts on or adjacent to the mirror by a plurality of suction cups 52 as a non-limiting example. Other attachment means are possible within the inventive concept.

Figure 5:
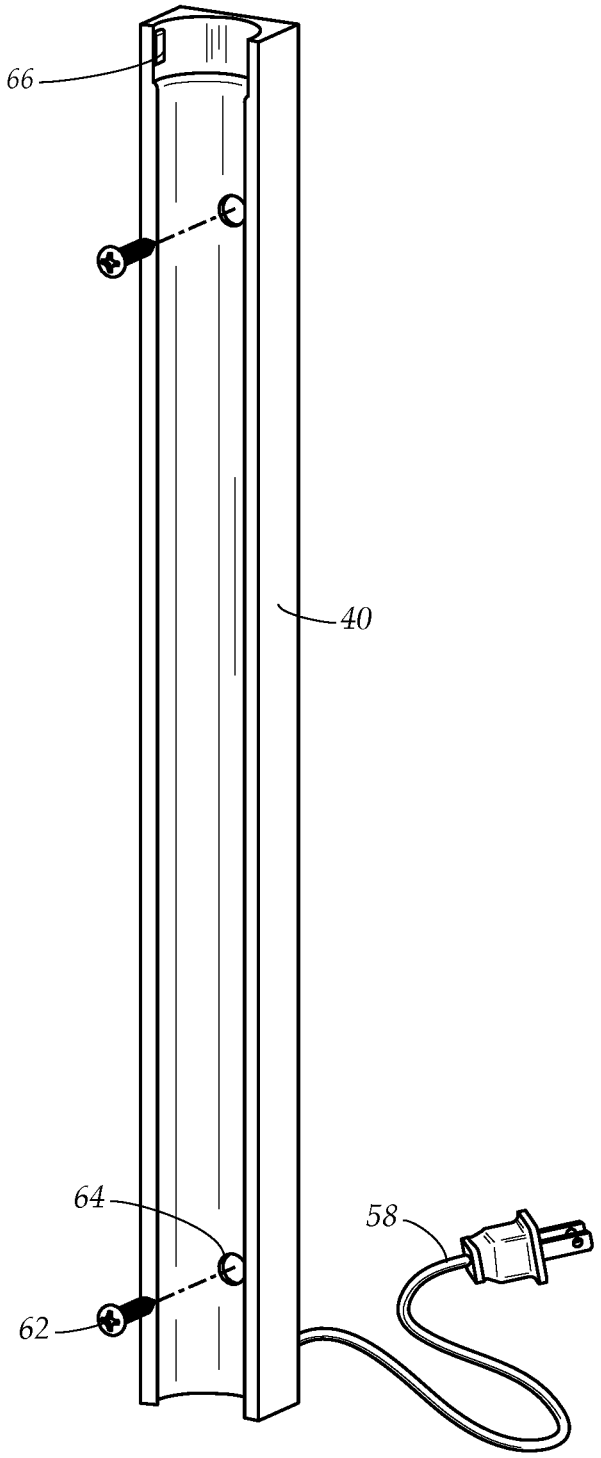
FIG. 5 is a perspective view of an example embodiment of the mounting box assembly.

FIG. 5 shows the mounting assembly 40 for permanent installation of the fixture adjacent to the mirror. As shown in the drawing as a non-limiting example embodiment, the mounting assembly attaches by a plurality of fasteners 62 through a plurality of mounting holes 64. The mounting assembly 40 has the at least one contact 66 configured for electrically coupling the fan assembly to the mounting assembly 40 and a power supply 58, such as a plug as a non-limiting example, for electrically connecting the mounting assembly 40 to electrical current. In other example embodiments, the mounting assembly 40 is wired directly to the electrical current.

Figure 6:
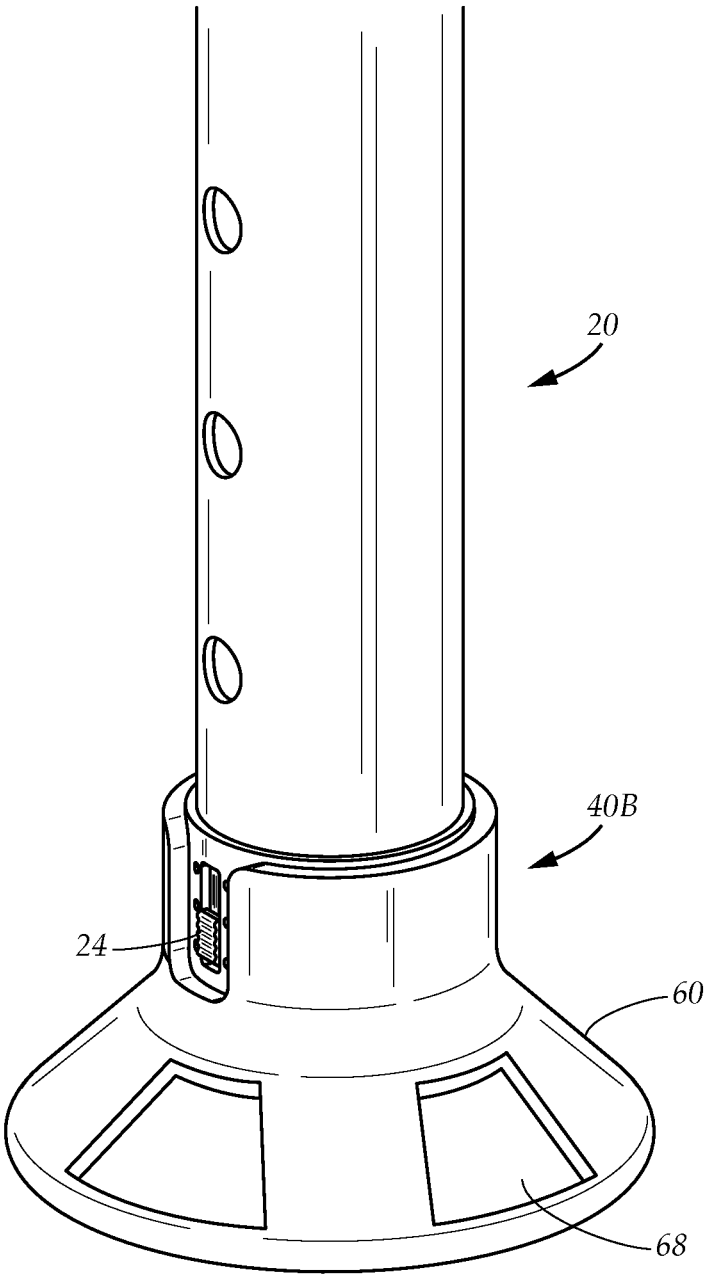
FIG. 6 is a perspective view of yet another example embodiment of a mounting base assembly coupled to the tube assembly.

FIG. 6 illustrates another example embodiment of the mounting assembly 40B. The mounting assembly 40B is a receptacle 60 with a plurality of vents 68. The tube assembly 20 stands upright in the receptacle 60. Inside the base is the electrical contact, which is not shown. The receptacle 60 is powered by electrical current or rechargeable battery, as described hereinabove with regard to the other example embodiments of the mounting assembly. The receptacle 60 has an opening for the at least one switch 24. The mounting assembly 40B is ideally configured for defogging pedestal mirrors.

Figure 8:
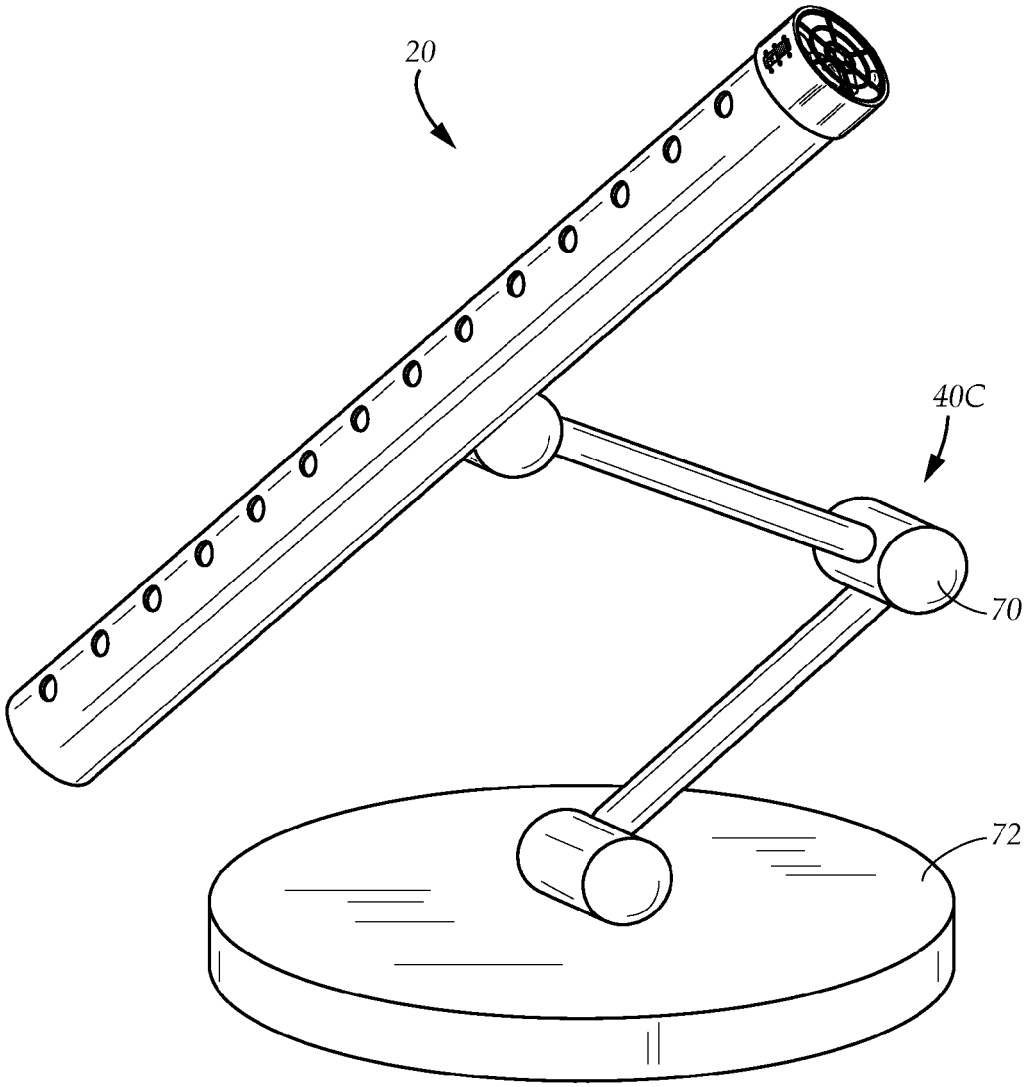
FIG. 8 is a perspective view of a further example embodiment of a mounting stand assembly coupled to the tube assembly.

FIG. 8 demonstrates yet another example embodiment of the mounting assembly 40C. Mounting assembly 40C is an articulated arm 70 on a base 72, operative for positioning the tube assembly 20 in proximity to a fogged mirror from a stowed position. Mounting assembly 40C is useful for all mirror configurations.

The tube assembly 20 electrically couples to the mounting assembly 40C. In one example embodiment, the mounting assembly 40C is manually adjusted for positioning the tube assembly 20 in proximity to the fogged mirror. In a further example embodiment, the articulated arm 70 has a servomotor, which is not shown, that positions the tube assembly 20 in proximity to the fogged mirror. In yet a further example embodiment, the servomotor is initiated by the sensor as explained hereinabove.

The tube assembly 20 is configured to function with the plurality of mounting assemblies described hereinabove. The mirror defogging system 10 shown in FIG. 7 further comprises a kit. In one example embodiment, the kit comprises the tube assembly 20, and at least one mounting assembly, such as the mounting assembly fixture 40 shown in FIG. 5 and the portable mounting assembly 40A. In another example embodiment, the kit further comprises the mounting assembly having an articulated arm 70 shown in FIG. 8. In yet another example embodiment, the kit further comprises the mounting assembly having a receptacle base 60 illustrated in FIG. 6. The kit further comprises a plurality of mounting assemblies.

In another example embodiment, the kit comprises the tube assembly 20 having louvers 44, shown in FIG. 3A, the mounting assembly fixture 40 shown in FIG. 5 and the portable mounting assembly 40A.

It is understood that when an element is referred hereinabove as being "on" another element, it can be directly on the other element or intervening elements may be present therebetween. In contrast, when an element is referred to as being "directly on" another element, there are no intervening elements present.

Moreover, any components or materials can be formed from a same, structurally continuous piece or separately fabricated and connected.

It is further understood that, although ordinal terms, such as, "first," "second," "third," are used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

Spatially relative terms, such as "beneath," "below," "lower," "above," "upper" and the like, are used herein for ease of description to describe one element or feature's relationship to another element(s) or feature(s) as illustrated in the figures. It is understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device can be otherwise oriented (rotated 90 degrees or at other orientations) and the spatially relative descriptors used herein interpreted accordingly.

Example embodiments are described herein with reference to cross section illustrations that are schematic illustrations of idealized embodiments. As such, variations from the shapes of the illustrations as a result, for example, of manufacturing techniques and/or tolerances, are to be expected. Thus, example embodiments described herein should not be construed as limited to the particular shapes of regions as illustrated herein, but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

In conclusion, herein is presented a mirror defogger system. The disclosure is illustrated by example in the drawing figures, and throughout the written description. It should be understood that numerous variations are possible, while adhering to the inventive concept. Such variations are contemplated as being a part of the present disclosure.

What is claimed is:

1. A mirror defogging system, comprising:

a tube assembly having a tube with an open end and a closed end, the tube having a longitudinal axis and a plurality of longitudinally recurring openings, the tube having an axial impeller and a plurality of heating elements towards the open end of the tube, the impeller and the plurality of heating elements configured for blowing heated air along the longitudinal axis through the openings; and a mounting assembly having a power supply, the tube assembly selectively coupling to the mounting assembly, the tube assembly electrically coupled to the mounting assembly, the mounting assembly powering the tube assembly impeller and tube assembly heating elements.

2. The mirror defogging system as described in claim 1, further comprises a moisture sensor operative for initiating the impeller and the heating elements.

3. The mirror defogging system as described in claim 2, wherein the tube assembly further comprises a plurality of adjustable louvers adjacent to the openings on the tube, the louvers operative for directing heated air onto the fogged mirror.

4. The mirror defogging system as described in claim 3, wherein the mounting assembly is a portable mounting assembly, the portable mounting assembly selectively attaching on or adjacent to a fogged mirror.

5. The mirror defogging system as described in claim 4, wherein the portable mounting assembly has a rechargeable battery configured for powering the tube assembly.

6. The mirror defogging system as described in claim 1, wherein the mounting assembly is a mounting box assembly, said mounting box assembly an installed fixture in proximity to the fogged mirror.

7. A mirror defogging system, comprising:

a tube assembly having a tube with an open end and a closed end, the tube having a plurality of longitudinally recurring openings, the tube having a longitudinal axis, the tube having an axial impeller and a plurality of heating elements towards the open end of the tube, the axial impeller and the plurality of heating elements blowing heated air along the longitudinal axis through the openings; and an articulated mounting assembly selectively coupling to the tube assembly, the mounting assembly having a power supply, the tube assembly electrically coupled to the power supply of the mounting assembly, the mounting assembly powering the tube assembly impeller and tube assembly heating elements.

8. The mirror defogging system as described in claim 7, further comprises a moisture sensor operative for initiating the impeller and the heating elements when a preset level of moisture is exceeded.

9. The mirror defogging system as described in claim 8, wherein the articulated mounting assembly has a servomotor configured for positioning the tube assembly in proximity to the fogged mirror from the stowed position.

10. The mirror defogging system as described in claim 9, wherein the servomotor is initiated by the moisture sensor when the preset level of moisture is exceeded prior to the impeller and heating elements are initiated.

11. The mirror defogging system as described in claim 7, wherein the tube assembly further comprises a plurality of adjustable louvers adjacent to the openings on the tube, the louvers operative for directing heated air onto the fogged mirror.

12. The mirror defogging system as described in claim 8, wherein the articulated mounting assembly has a rechargeable battery configured for powering the tube assembly.

13. A mirror defogging system, comprising:

a tube with an open end and a closed end, the tube having a plurality of longitudinally recurring openings, the tube having at least one electrical contact for coupling to a power supply, the tube having an longitudinal axis;

an axial impeller inside the tube towards the open end of the tube;

a plurality of heating elements behind the impeller towards the open end of the tube, the impeller and the plurality of heating elements blowing heated air through the openings;

a mounting assembly having said power supply; and a plurality of adjustable louvers adjacent to the openings on the tube.

14. The mirror defogging system as described in claim 13, wherein the plurality of adjustable louvers are connected together by a bar extending along the edges of the louvers, the bar configured for adjusting the louvers simultaneously.

15. The mirror defogging system as described in claim 14, further comprises a sensor operative for initiating the impeller and the heating elements.

16. The mirror defogging system as described in claim 15, wherein the sensor senses condensate.

17. The mirror defogging system as described in claim 16, wherein the impeller is an axial impeller having an axis of rotation orthogonal to the tube.

18. The mirror defogging system as described in claim 17, wherein a grill covers the open end of the tube.

19. The mirror defogging system as described in claim 18, wherein the impeller speed is variable.

20. The mirror defogging system as described in claim 19, wherein the open end of the tube has a collar and the collar and grill form a resonator.

* * * * *